US005570527A

United States Patent [19]

Felicci

[11] Patent Number: 5,570,527

[45] Date of Patent: Nov. 5, 1996

[54] SEMI-AUTOMATIC PISTOL WITH A DUAL SAFETY

[76] Inventor: Joseph E. Felicci, 500 Bayview Dr., Miami Beach, Fla. 33160

[21] Appl. No.: 390,800

[22] Filed: Feb. 17, 1995

[51] Int. Cl.[6] ..... F41A 17/26

[52] U.S. Cl. ..... 42/70.08; 42/70.02

[58] Field of Search ..... 42/70.08, 70.02, 42/70.01; 89/146, 147

[56] References Cited

U.S. PATENT DOCUMENTS

| | | | |
|---|---|---|---|
| 1,972,763 | 9/1934 | Dutton | 42/70.08 |
| 2,655,839 | 10/1953 | Ruger | 89/196 |
| 2,691,232 | 10/1954 | Hoopes | 42/70.08 |
| 3,069,976 | 12/1962 | Stevens, Jr. | 89/191 |
| 3,682,040 | 8/1972 | Roy | 89/132 |
| 3,889,412 | 6/1975 | Filecci | 89/147 |
| 4,428,138 | 1/1984 | Seecamp | 42/70.02 |
| 4,967,502 | 11/1990 | Vernon | 42/70.08 |
| 5,231,237 | 7/1993 | Cupp | 42/71.02 |

FOREIGN PATENT DOCUMENTS

| | | | |
|---|---|---|---|
| 192343 | 8/1986 | European Pat. Off. | 42/70.01 |

*Primary Examiner*—Stephen M. Johnson
*Attorney, Agent, or Firm*—Jacobson, Price, Holman & Stern, PLLC

[57] ABSTRACT

A semi-automatic pistol having a unique interrelationship between a pivotal, spring biased trigger, a pivotal spring biased hammer and a dual safety with one safety disabling the connection between the trigger and the hammer and the second safety enabling removal of the spring biasing force that normally moves the hammer from cocked position to firing position thereby preventing the pistol from being fired.

6 Claims, 3 Drawing Sheets

SEMI-AUTOMATIC PISTOL WITH A DUAL SAFETY

BACKGROUND OF THE INVENTION

1. Field of the Invention

The present invention generally relates to a semiautomatic pistol having a unique interrelationship between a pivotal, spring biased trigger, a pivotal spring biased hammer and a dual safety with one safety being conventional by disabling the connection between the trigger and the hammer and the second safety enabling removal of the spring biasing force that normally moves the hammer from cocked position to firing position thereby preventing the pistol from being fired.

2. Description of the Prior Art

My prior U.S. Pat. No. 3,889,412 discloses a semiautomatic pistol utilizing a rigid frame, spring biased pivotal hammer, spring biased pivotal trigger, drawbars interconnecting the trigger and hammer to move the hammer to a cocked position and releasing the hammer for spring biased movement to a firing position with a movable safety engaging the drawbars to move the drawbars out of engagement with the hammer thereby disabling the connection between the trigger and hammer. This prior patent does not disclose the unique construction of the hammer spring support received in the frame which includes a spring biased pivotal cartridge magazine lock and release and a structure which enables the hammer spring support to be moved from a position for biasing the hammer toward firing position to a position in which the spring biasing force is completely removed from the hammer thereby providing a second safety by disabling the spring biasing force which normally moves the hammer from a cocked to a firing position engaging a firing pin.

SUMMARY OF THE INVENTION

An object of this invention is to provide a semiautomatic pistol which includes dual safeties with one of the safeties being substantially the same as shown in U.S. Pat. No. 3,889,412 which disables the connection between the trigger and the hammer together with a second safety which disables the hammer spring by moving the hammer spring support away from the hammer to remove the spring biased force normally exerted on the hammer and which normally pivots the hammer from a cocked position to a firing position when the hammer is released in response to pivotal movement of the trigger to a firing position.

Another object of the invention is to provide a semiautomatic pistol in accordance with the preceding object in which the hammer spring support includes a spring biased cartridge magazine latch which enables the magazine to be released and inserted without changing the position of the hammer spring support.

A further object of the invention is to provide a semiautomatic pistol in accordance with the preceding objects in which the hammer spring support is engaged with a pair of shoulders or ledges formed in the frame with inward movement of the magazine latch causing inward or upward movement of the hammer spring support for disengagement from the shoulders or ledges to enable the hammer spring support to move downwardly in relation to the hammer and handle portion of the frame for releasing the spring biased force normally exerted by the hammer spring on the hammer.

Still another object of the invention is to provide a semi-automatic pistol in accordance with the preceding objects in which the rear contour of the frame and rear surface of the hammer are substantially flush when the hammer is in uncocked or firing position in order to eliminate unnecessary projections extending beyond the frame to eliminate the possibility of the projections becoming entangled with clothing or other articles which may be engaged by the projections. The structure of the frame, receiver and hammer enabling the slide to be removed without removal of a closure member as illustrated in U.S. Pat. No. 3,889,412.

Yet another object of the invention is to provide a semiautomatic pistol in accordance with the preceding objects utilizing a plastic one piece hand grip, a unique two piece magazine retainer and hammer spring support with the rear edge of the hammer conforming to the rear contour of the frame or receiver with the components of the pistol providing a relatively easily assembled and disassembled gun which is light weight and provided with external contour surfaces which enhance operation of the pistol.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
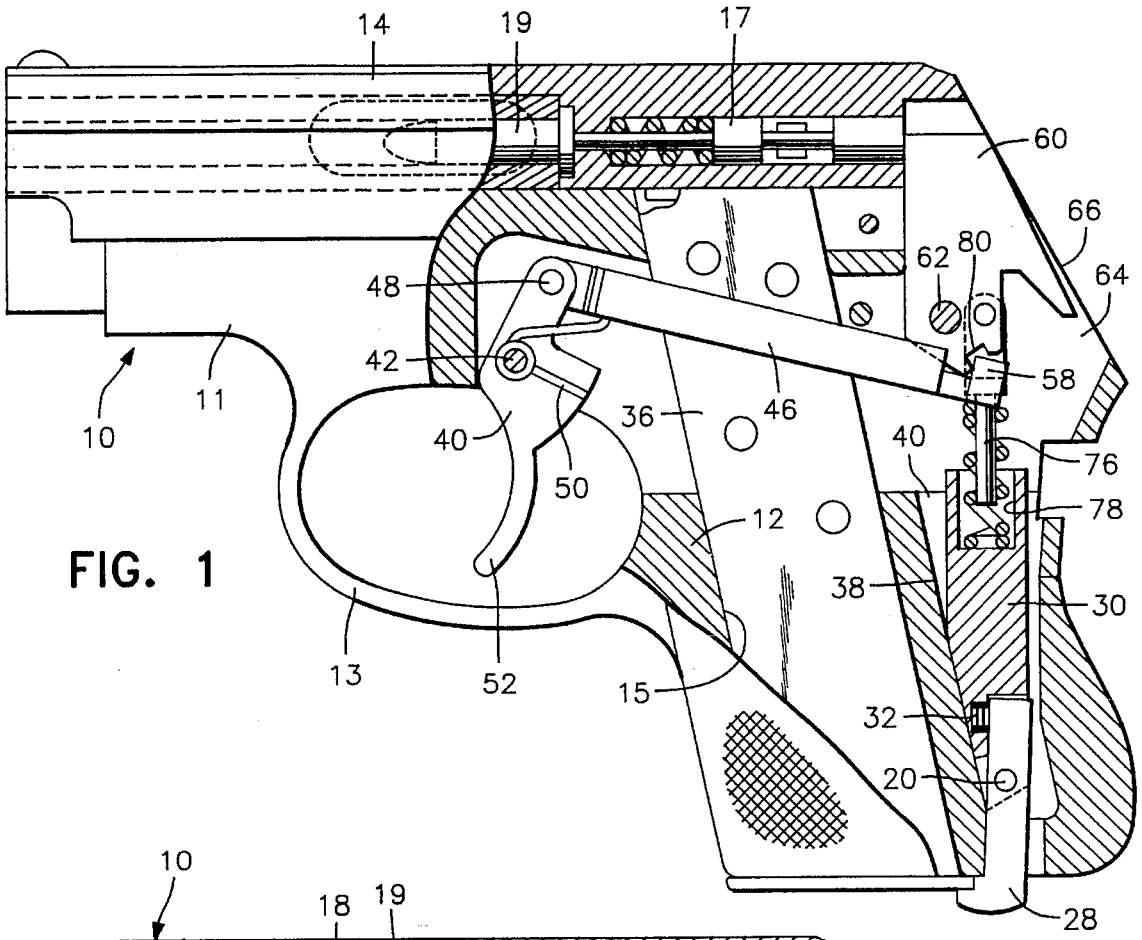
FIG. 1 is a side elevational view of a semi-automatic pistol with portions broken away illustrating the novel structure of the cartridge magazine retainer combined with the hammer spring support with the hammer in uncocked or fired position and the trigger in a forwardly pivoted position to initiate movement of the hammer toward cocked position when the trigger is pulled rearwardly.

Referring now specifically to the drawings, the semiautomatic pistol is generally designated by reference numeral 10 and includes a frame or receiver 11 including a depending handle forming portion 12, a trigger guard 13 and a barrel supporting slide 14 which structure is the same as that illustrated in U.S. Pat. No. 3,889,412. The downwardly extending handle portion 12 includes a cavity or passageway 15 with the handle portion 12 including a hand grip 16 of U-shaped, one piece plastic construction which slides over the handle portion and is contoured to provide a lightweight structure having a contour to enable effective gripping of the pistol when handling and using the pistol. The structure of the firing pin 17, barrel 18 and the manner in which cartridges 19 are moved into the chamber for firing are conventional and form no particular part of the present invention.

Figure 5:
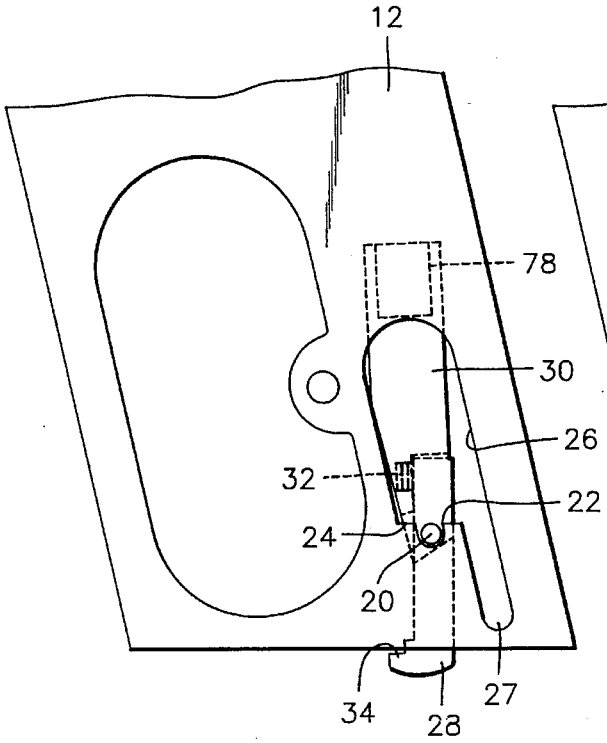
FIG. 5 is fragmental view illustrating the construction of the hammer spring support and cartridge magazine latch when the hammer spring support is in operative position.
Figure 6:
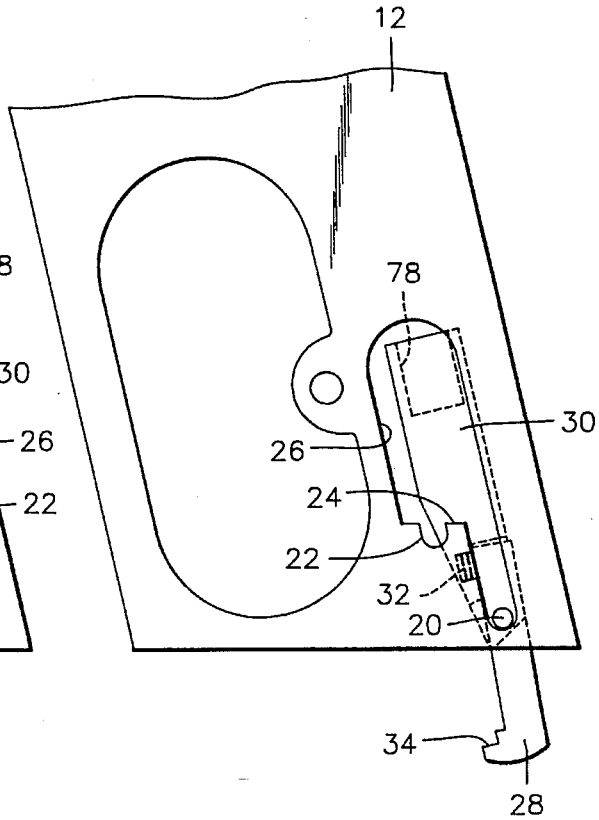
FIG. 6 is a fragmental view similar to FIG. 5 illustrating the combined cartridge retainer and hammer spring support in a downwardly extended position which releases the spring bias of the hammer spring against the hammer thereby preventing the hammer from being moved from a released cocked position to a firing position which normally occurs due to the spring bias force exerted by the hammer spring.
Figure 7:
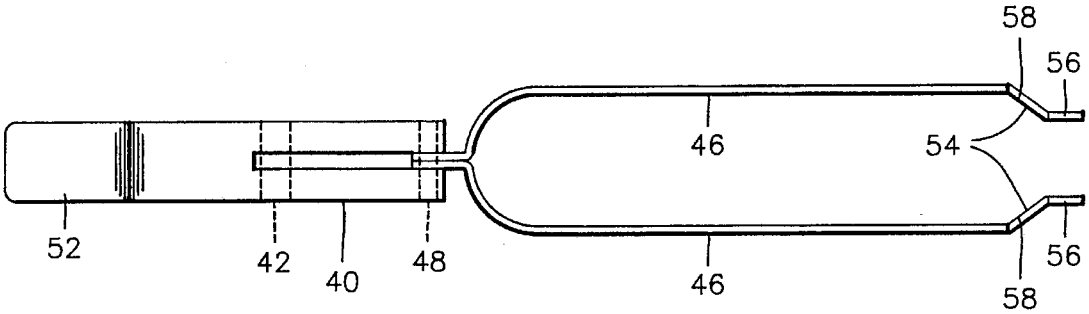
FIG. 7 is a fragmental plan view of the trigger and drawbars illustrating the structure of these components.

The pistol may include a first safety in the form of an externally operated pivotal safety such as illustrated in FIG. 7 of U.S. Pat. No. 3,889,412 and identified at 102–120 or the pivotal external safety may extend internally of the frame and include an offset end engaging the drawbars 46 to disengage them from a hammer 60. A significant feature of this invention involves a structure in which tension on the hammer spring 76 is released by pushing a hammer spring support 30 upwardly to disengage pin 20 from upwardly opening notches 22 formed in shoulders 24 spaced upwardly from the lower end of a slot 26 formed in the handle portion 12. The upper portion 25 of the slot 26 is wider than the lower portion 27 with the shoulder 24 defining the reduction in width of the slot 26. The lower end 28 of the hammer spring support 30 can be engaged and moved upwardly a sufficient distance to lift the pin 20 out of the notches 22 and then moved rearwardly in order for the pin 20 and support 30 to drop into the narrow lower end portion 27 of the slot 26 as illustrated in FIGS. 5 and 6. When the pin 20 and the spring support 30 drops into the lower end 27 of the slot 26, the spring force exerted on the hammer 60 will be removed thereby forming a secondary safety which can be actuated quickly by merely moving the spring support 30 upwardly and rearwardly and dropping the pin 20 and support 30 downwardly into the narrow end 27 of the slot 26. The secondary safety can be quickly rendered effective and also quickly rendered ineffective by forcing the lower end 28 of the spring support 30 upwardly until the pin 20 is positioned above the shoulders 24 at which time the lower end of the spring support 30 is moved forwardly to register the pin 20 with the notches and to drop the pin into the notches 22.

Also, the lower end 28 of the hammer spring support 30 is pivoted about the pin 20 and is biased by spring 32 in a direction in which the lower end 28 is biased forwardly so that the forwardly projecting lip 34 will engage under the rear edge of the magazine 36 as illustrated in FIG. 1. When the pin 20 is received in the notches 22, the pin 20 forms a pivotal connection for the lower end 28 of the spring support 30 which rests against the forward surface 38 of the cavity 40 in the handle portion. As illustrated in FIG. 1, the lower end 28 of the spring support 30 can be pivoted against spring 32 about pivot pin 20 to move the lip 34 rearwardly to release the magazine and also enable the magazine to be reinserted. In order to release the hammer spring support 30 by elevating the pin 20 out of the notches 22, the magazine must first be removed by releasing the magazine latch formed by the lip 34 on the pivotal lower end 28 of the main spring support 30.

Figure 3:
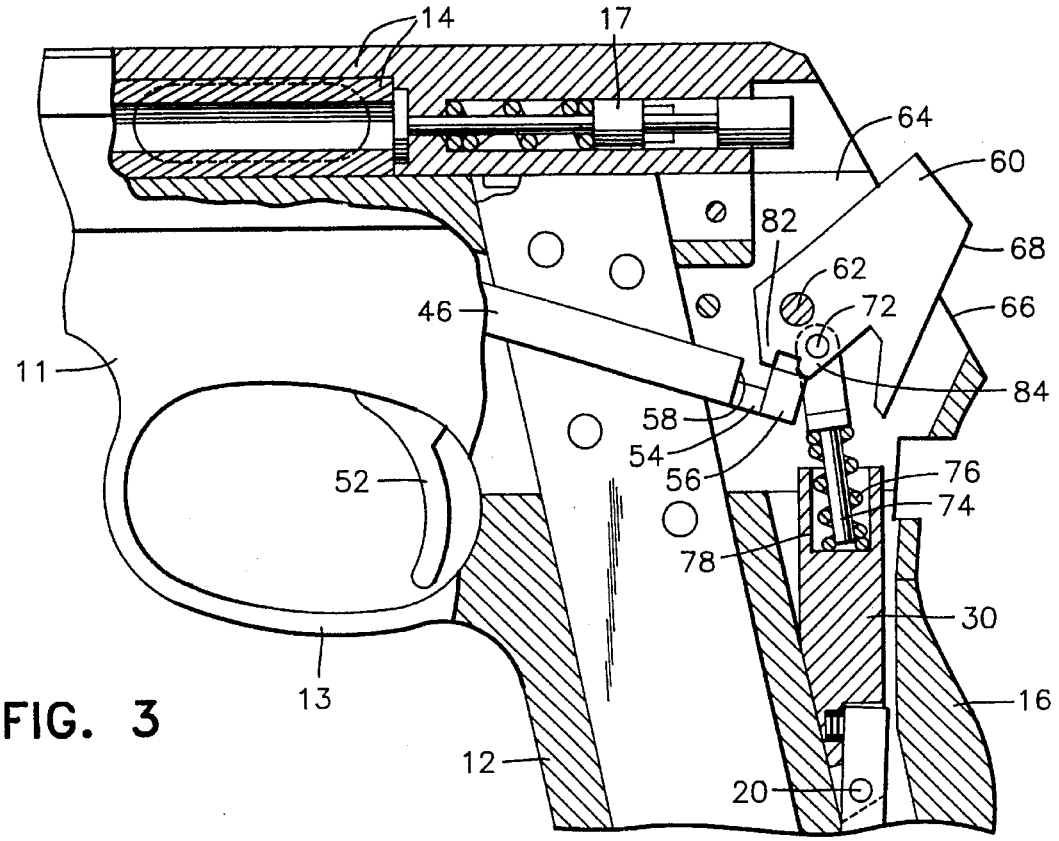
FIG. 3 is a sectional view similar to FIGS. 1 and 2 illustrating the hammer in fully cocked and released position so that the hammer spring will pivot the hammer toward firing position to engage the firing pin for firing a cartridge in the chamber.
Figure 4:
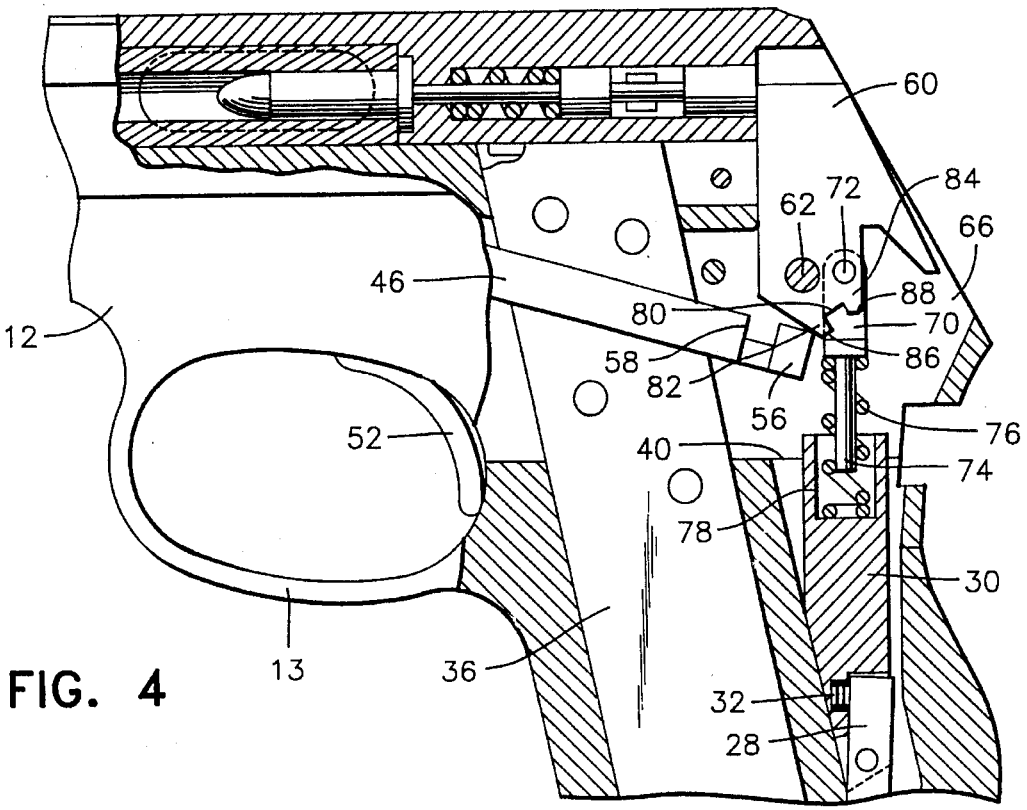
FIG. 4 is a sectional view similar to FIGS. 1–3 illustrating the hammer in fired position with the trigger still in its rear most position and illustrating the association of the drawbars and hammer prior to the trigger moving forwardly to reengage the drawbars with the hammer.

A trigger 40 is pivotally supported by trigger pivot pin 42 from the frame 11. The upper end of trigger 40 is pivotally connected to a pair of drawbars 46 by pivot pin 48. A trigger spring 50 biases the finger engaging lower end portion 52 of the trigger 40 forwardly and biases the drawbars 46 rearwardly and upwardly. The drawbars 46 extend rearwardly in straddling relation to the cartridge magazine 36 as illustrated in FIG. 7 and the drawbars 46 are laterally inwardly offset at their rearward ends as designated by reference numeral 54 and terminate in two short flanges 56. The offset portions 54 of the drawbars 46 include an upwardly opening notch 58 which extends throughout the length of the offset portion 54 and slightly into the parallel portion of the drawbars. The rearmost flanges 56 have a top edge that is aligned with the top edge of the drawbars 46 as illustrated in FIG. 4. The specific construction of the rearward ends of the drawbars 46 cooperate with the hammer 60 which is supported by the pivot pin 62 for swinging movement in relation to a cavity 64 in the frame 11. The cavity 64 includes an inclined rear edge 66 which substantially coincides with an inclined rear surface 68 on the hammer 60 as illustrated in FIGS. 3 and 4. The hammer includes a U-shaped yoke 70 pivotally attached thereto adjacent the lower end by a pivot pin 72 spaced from the supporting pivot pin 62 for the hammer 60. The yoke 70 includes a depending pin 74 telescopically received in the coil spring 76 which biases the hammer 60. The lower end of spring 76 is received in a cavity 78 in the upper end of the spring support 30. These components are associated in a manner that when the hammer 60 is moved to a cocked position, the spring 76 will be compressed and provide the force for rapid pivotal movement of the hammer 60 from the fully cocked position and released position as illustrated in FIG. 3 to the firing position illustrated in FIG. 4.

The trigger 40 and drawbars 46 are positioned as illustrated in FIG. 1 after the hammer has moved to the firing or uncocked position. In this position, the notches 58 and the terminal flanges 56 which define the rear edge of the notch are engaged with a notch 80 formed in the lower end of the hammer 60. The notch 80 is defined by a forward projection 82 and a rearward projection 84 each of which is provided with a lower end surface 86 and 88 which cooperate with the notches 58 and the upper surfaces of the drawbar 46 and the terminal end flanges 56 thereon when moved forwardly from the position in FIG. 1 in which the trigger spring 50 biases the rearward ends of the drawbars upwardly so that the forward projection 82 on the hammer 60 is received in the notches 58 and the rearward projection 84 engages upper edges of the terminal flanges 56.

Figure 2:
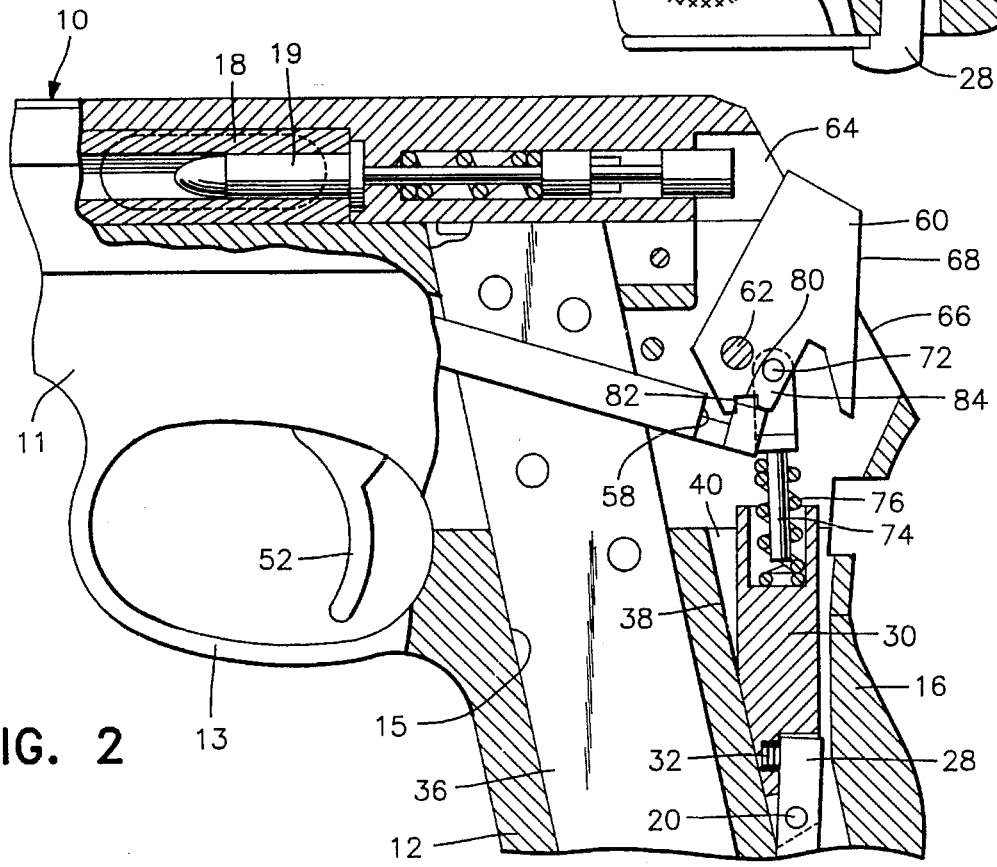
FIG. 2 is a sectional view similar to FIG. 1 and illustrating rearward movement of the trigger, forward movement of the drawbars and partial movement of the hammer toward cocked position.

With the drawbars 46 thus engaged with the notch 80 on the lower end of the hammer, the trigger 40 can be pivoted rearwardly about pivot pin 42 thus moving the drawbars 46 forwardly toward the position illustrated in FIG. 2 which causes the hammer 60 to pivot rearwardly about the pivot pin 62 to a partially cocked position. Continued forward movement of the drawbars beyond the position of FIG. 2 occurs as the finger engaging portion 52 of the trigger 40 is pulled rearwardly toward the position illustrated in FIG. 3. As the drawbars 46 move forwardly, the notch 80 in the hammer 60 and the forward projection 82 will be released from the notches 58 by engagement of the surface 88 of the projection 84 with the top edge portions of the terminal flanges 56 on the drawbars which pivots the rearward ends of the drawbars downwardly so that the drawbars will clear the surfaces 86 and 88 and the notch 80 under the bias of compressed hammer spring 76 thus rapidly moving the hammer 60 from a fully cocked position to a firing position. FIG. 3 illustrates the released position of the drawbars 46 and FIG. 4 illustrates the hammer 60 in its firing position with the finger engaging portion 52 of the trigger 40 still at the rearward end of its travel and the drawbars at the forward end of their travel. Upon subsequent release of the trigger 40, the drawbars move rearwardly and reengage with the notch and the projections on the lower end of the hammer 60 as illustrated in FIG. 1 for a repeat cycle of operation.

Assuming that the components are in the position of FIG. 1 in which the hammer 60 is in uncocked position and the trigger 40 has the finger engaging portion 52 positioned forwardly by the spring 50 which also biases the rearward ends of the drawbars 46 upwardly, upon rearward movement of the finger engaging portion 52 of the trigger, the notches 58 in the drawbars 46 will engage the forward edge of the notch 80 defined by the projection 82 and pivot the lower end of the hammer 60 forwardly and move the upper end of the hammer 60 rearwardly about pivot pin 62 toward the position illustrated in FIG. 2. From the position illustrated in FIG. 2, further rearward movement of the finger receiving portion 52 from the position illustrated in FIG. 2 toward the position illustrated in FIG. 3, the projection 84 at the trailing edge of the lower edge of the hammer 60 will engage the top edge of the terminal flanges 56 at the same time as the trailing edge of the notch 58 and the leading edge of the notch 80 move in relation each other until the top edge of the terminal flanges 56 align with the bottom edge of the projection 82 at which time the hammer 60 is released from the drawbars as illustrated in FIG. 3 at which point the spring 76 causes the hammer to move rapidly about pivot pin 62 so that the upper end portion thereof will impact the firing pin 17 as the hammer moves to the firing position illustrated in FIG. 4. Subsequent release of trigger 40 enables it and the drawbars 46 to move to the position of FIG. 1 for the next cycle of operation. The operation of the second safety by releasing the bias force of the spring 76 is described previously.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A semi-automatic pistol comprising a frame including a receiver and a depending handle, a trigger pivotally mounted on said frame generally at the intersection of the handle and receiver, said trigger including a finger receiving portion and an upper portion, a hammer pivotally mounted in said frame for movement about a pivot axis between cocked and firing position, drawbar means connected to said upper portion of said trigger and extending rearwardly toward and in underlying relation to a lower end of said hammer, spring means biasing the finger receiving portion of the trigger forwardly and the drawbar means forwardly and upwardly for engaging the drawbar means with said lower end of the hammer, coacting engagable means on the lower end of the hammer and the drawbar means to pivot the hammer to said cocked position and release the hammer for pivotal movement to said firing position, a hammer spring engaged with said hammer for spring biasing the hammer toward said firing position, a hammer spring support mounted on said handle to support the hammer spring in position for biasing the hammer toward said firing position, means supporting the hammer spring support on the handle of the frame to enable the hammer spring support to be released and moved downwardly away from the hammer to release the spring bias force exerted by the hammer spring on the hammer thereby forming a safety to enable the hammer to remain in a non-firing position even when the trigger and drawbar means are actuated, said handle including a generally vertically disposed cavity receiving a cartridge magazine, said hammer spring support including a magazine retainer at a lower end thereof for releasably securing the cartridge magazine in the handle, said hammer spring support and magazine retainer being interconnected by a hinge pin, a spring biasing the magazine retainer into engagement with the magazine and enabling the retainer to move away from the magazine for removal and insertion of the magazine in the handle.

2. The pistol as defined in claim 1 wherein said means supporting the hammer spring support on the handle for biasing the hammer toward said firing position including a pair of shoulders in said handle, said hinge pin interconnecting the magazine retainer and the hammer spring support having ends extending laterally and engaged with notches in upwardly facing surfaces on said shoulders to maintain the hammer spring under compression, said magazine retainer and hammer spring support being moveable upwardly by minimal compression of the hammer spring to enable the laterally extending ends of the pin to be removed from the notches and moved into a slot in said handle to enable the hammer spring support to move away from the hammer spring to release the spring bias force exerted by said hammer spring on the hammer to disable the hammer thereby forming a safety to render the hammer incapable of firing a cartridge.

3. The pistol as defined in claim 1 wherein said receiver and said hammer include inclined rearward surfaces oriented in flush relationship to each other when the hammer is in said firing position.

4. The pistol as defined in claim 1 wherein the coacting engagable means between the drawbar means and lower end of the hammer includes an upwardly facing notch in the drawbar means, a downwardly facing notch in said lower end of the hammer defined by two projections having generally flat lower ends, a trailing edge of the notch in the drawbar means engaging a leading edge of the notch in the hammer for pivoting an upper end of the hammer rearwardly, said lower end of the hammer moving forwardly and compressing the hammer spring when the drawbar means is moved forwardly, said flat ends on the trailing projection of the hammer engaging the drawbar means rearwardly of the notch as the drawbar means moves forwardly and causing the drawbar means to move downwardly in relation to said pivot axis of the hammer for releasing the notch in the drawbar means from the notch in said lower end of the hammer as the flat end of the projection forming the leading edge of the notch in the hammer is elevated above a top corner of the trailing edge of the notch in the drawbar means to release the hammer to enable the compressed hammer spring to rapidly pivot the hammer towards said firing position for engagement with a firing pin.

5. A semi-automatic pistol comprising a frame including a receiver and a depending handle, a trigger pivotally mounted on said frame generally at the intersection of the handle and receiver, said trigger including a finger receiving portion and an upper portion, a hammer pivotally mounted in said frame for movement about a pivot axis between cocked and firing position, drawbar means connected to said upper portion of said trigger and extending rearwardly toward and in underlying relation to a lower end of said hammer, spring means biasing the finger receiving portion of the trigger forwardly and the drawbar means forwardly and upwardly for engaging the drawbar means with said lower end of the hammer, coacting engagable means on the lower end of the hammer and the drawbar means to pivot the hammer to said cocked position and the release the hammer for pivotal movement to said firing position, a hammer spring engaged with said hammer for spring biasing the hammer toward said firing position, a hammer spring support mounted on said handle to support the hammer spring in position for biasing the hammer toward said firing position, means supporting the hammer spring support on the handle of the frame to enable the hammer spring support to be released and moved downwardly away from the hammer to release the spring bias force exerted by the hammer spring on the hammer thereby forming a safety to enable the hammer to remain in a non-firing position even when the trigger and drawbar means are actuated, wherein the coacting engagable means between the drawbar means and lower end of the hammer including an upwardly facing notch in the drawbar means, a downwardly facing notch in said lower end of the hammer defined by two projections having generally flat lower ends, a trailing edge of the notch in the drawbar means engaging a leading edge of the notch in the hammer for pivoting an upper end of the hammer rearwardly, said lower end of the hammer moving forwardly and compressing the hammer spring when the drawbar means is moved forwardly, said flat ends on the trailing projection of the hammer engaging the drawbar means rearwardly of the notch as the drawbar means moves forwardly and causing the drawbar means to move downwardly in relation to said pivot axis of the hammer for releasing the notch in the drawbar means from the notch in said lower end of the hammer as the flat end of the projection forming the leading edge of the notch in the hammer is elevated above a top corner of the trailing edge of the notch in the drawbar means to release the hammer to enable the compressed hammer spring to rapidly pivot the hammer towards said firing position for engagement with a firing pin, said handle including a generally vertically disposed cavity receiving a cartridge magazine, said hammer spring support including a retainer at a lower end thereof for releasably securing the cartridge magazine in the handle, said hammer spring support being constructed of two components interconnected by a hinge pin, one of said components being said retainer and a spring biasing the magazine retainer on the lower end of the spring support into engagement with the magazine and enabling the retainer to move away from the magazine for removal and insertion of the magazine in the handle.

6. The pistol as defined in claim 5 wherein said means supporting the hammer spring support on the handle for biasing the hammer toward said firing position includes a pair of shoulders in said handle, said hinge pin interconnecting the magazine retainer and the hammer spring support having ends extending laterally and engaged with notches in upwardly facing surfaces on said shoulders to maintain the hammer spring under compression, said magazine retainer and hammer spring support being moveable upwardly by minimal compression of the hammer spring to enable the laterally extending ends of pin to be removed from the notches and moved into a slot in said handle to enable the hammer spring support to move away from the hammer spring to release the spring bias force exerted by said hammer spring on the hammer to disable the hammer thereby forming a safety to render the hammer incapable of firing a cartridge.

* * * * *